US006295971B1

(12) United States Patent
Peters et al.

(10) Patent No.: US 6,295,971 B1
(45) Date of Patent: Oct. 2, 2001

(54) LUBRICATING OIL AND FUEL BLENDING SYSTEM

(75) Inventors: Lester L. Peters; Thomas M. Yonushonis; Raymond J. Amlung, all of Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/577,667

(22) Filed: May 25, 2000

(51) Int. Cl.[7] ..... F02M 47/02
(52) U.S. Cl. ..... 123/495; 239/88
(58) Field of Search ..... 123/495, 509; 239/88, 89, 90, 91, 92

(56) References Cited

U.S. PATENT DOCUMENTS

| | | | | |
|---|---|---|---|---|
| 3,447,636 | | 6/1969 | Bonfilio . | |
| 4,417,561 | | 11/1983 | Yasuhara . | |
| 4,421,078 | | 12/1983 | Hurner . | |
| 4,470,545 | * | 9/1984 | Deckard et al. | 239/88 |
| 4,495,909 | | 1/1985 | Hurner . | |
| 4,617,879 | | 10/1986 | Mori . | |
| 4,869,346 | | 9/1989 | Nelson . | |
| 5,020,484 | | 6/1991 | Ishikawa et al. . | |
| 5,056,469 | | 10/1991 | Kimberley . | |
| 5,370,089 | | 12/1994 | Harada . | |
| 5,390,762 | | 2/1995 | Nelson . | |
| 5,431,138 | | 7/1995 | Hurner . | |
| 5,554,278 | | 9/1996 | Henderson . | |
| 5,720,249 | | 2/1998 | Betts et al. . | |
| 5,749,339 | | 5/1998 | Graham et al. . | |
| 6,032,875 | * | 3/2000 | Grimshaw-Jones | 239/92 |

FOREIGN PATENT DOCUMENTS

| | | |
|---|---|---|
| 867711 | 5/1961 | (GB) . |
| 61-160509 | 7/1986 | (JP) . |

* cited by examiner

*Primary Examiner*—Noah P. Kamen
(74) *Attorney, Agent, or Firm*—Nixon Peabody LLP; Charles M. Leedom, Jr.; Tim L. Brackett, Jr.

(57) ABSTRACT

A lube oil and fuel blending system, pumping device and method are provided which effectively, inexpensively and controllably removes used lube oil from an engine and delivers the lube oil to the fuel system for consumption within the engine. The lube oil and fuel blending system includes a fuel pumping device or injector containing a bore and a plunger reciprocally mounted in the bore for movement through a retraction stroke and an advancement stroke, each having a predetermined stroke length. A fuel drain circuit communicates with the bore at a drain location spaced a predetermined seal length axially along the bore from an outer opening of the bore through which the plunger extends. The predetermined seal length is specifically designed less than the predetermined stroke length to cause lube oil on the outer portion of the plunger to be delivered by the plunger to the fuel drain circuit at the drain location. Fuel leakage through the fuel drain circuit washes the lube oil from the plunger thereby blending the lube oil and fuel and delivering the blend to the fuel supply system via a return line. A variable restriction valve may be provided in the return line to control the leakage flow. Therefore, the predetermined seal length can be chosen relative to the stroke to achieve a desired leakage rate. In another embodiment, an undercut may be used to increase the used lube oil leakage rate.

16 Claims, 3 Drawing Sheets

LUBRICATING OIL AND FUEL BLENDING SYSTEM

TECHNICAL FIELD

This invention relates to an electronically controlled system for automatically blending an engine's used lubricating oil with the engine fuel to increase the oil drain interval while maintaining an acceptable lube oil concentration in the fuel regardless of operating conditions.

BACKGROUND OF THE INVENTION

It is highly desirable to be able to minimize the amount of service required for internal combustion engines to thereby minimize the interruption in the use of the vehicle/equipment. Degradation of engine lubricating oil during engine use requires oil changing procedures which account for a significant portion of the maintenance and associated engine "down time". Conventional periodic oil changes generate an accumulation of waste lubricating oil which must be disposed of and/or processed resulting in undesirable costs. Therefore, extending oil drain intervals and reducing waste disposal are of great value to vehicle/equipment operators.

Consequently, systems have been developed for automatically changing internal combustion engine crankcase oil during engine operation. For example, U.S. Pat. No. 3,447,636 discloses a system for automatically changing engine oil while the engine is operating. The system operates to drain substantially all of the used oil from the engine immediately prior to introducing fresh oil into the engine from a reservoir. The single operation process results in a complete change of substantially the entire engine oil volume. However, draining the engine prior to refilling with fresh oil necessarily creates a risk that an inadequate supply of lube oil exists in the engine for an interim time period possibly resulting in damage or excessive wear to engine components from insufficient lubrication. Moreover, this system undesirably results in a quantity of waste oil.

Other systems have been developed which automatically change engine lube oil during engine operation while avoiding a waste quantity of oil by directing the used lube oil into the fuel system for burning with the fuel in the engine. These systems periodically drain a small amount of the used oil from the engine lube oil system, and replace the drained quantity with fresh lubricant from an auxiliary tank. One type of automatic oil changing system injects used lube oil into the fuel system at fixed time intervals preset by a time device. For example, U.S. Pat. Nos. 4,869,346 and 5,390,762 to Nelson disclose an automatic crankcase oil change and makeup system including a displacement unit having a piston with a predetermined stroke set to deliver identical, predetermined amounts of fresh oil during each stroke at the same flow rate and volume as the extraction of used oil. The frequency of the pressure strokes is set by a timer in an electronic controller, and is adjustably set to stroke at fixed time intervals to provide a cumulative quantity of fresh oil to the crankcase according to the regular recommended oil change period for the particular engine. A pair of dials on the controller enable the frequency of the pressure strokes to be adjusted. U.S. Pat. Nos. 4,421,078; 4,495,909; and 5,431,138 to Hurner disclose similar systems for oil changing and making up during engine operation which include a control module having an adjustable impulse timer set to periodically cycle an air pressure operated oil extractor pump at a fixed time intervals to direct a predetermined amount of engine oil out of the oil pan and into the fuel tank. Fresh makeup oil is pumped from an oil reservoir to the crankcase, also by air pressure, in response to a low level signal from a dipstick sensor. Similarly, U.S. Pat. No. 4,417,561 to Yasuhara discloses an automatic oil changing and disposing apparatus wherein used crankcase oil is periodically directed to a fuel tank via a valve controlled by an odometer switch, and fresh oil is gravity fed from a fresh oil tank to the crankcase via a control valve controlled by a crankcase oil level switch. The quantity of each increment of used oil removed from the crankcase, and each increment of fresh oil supplied, is controlled by respective timers having variable on-time duration to effect variable control of engine oil extraction and addition.

Injecting lubricating oil into engine fuel results in additional emissions related to the lube oil/fuel concentration or ratio. Upcoming government regulations may require emissions compliance at a "worst case" lube oil/fuel concentration during engine operation. Although capable of automatically changing lube oil during engine operation, the timer-based automatic oil changing systems discussed hereinabove inject more than an optimum amount of lube oil from the crankcase into the fuel system when the engine is being used less heavily than expected. As a result, these systems will likely result in an unacceptably high "worst case" lube oil/fuel concentration, especially when the engine is operated under sustained low load operation, rendering such systems extremely difficult, if not impossible, to certify due to extremely high particulate matter levels. Moreover, excessive concentrations of used oil in the fuel results in engine performance degradation, shortened fuel filter life and wasted oil. These timer-based systems also are likely to inject less than an optimum amount of lube oil into the fuel system when the engine is being used more heavily than expected. Injecting too little used oil from the oil sump into the fuel system will disadvantageously result in engine damage from over-used oil incapable of adequately lubricating and cooling engine components.

U.S. Pat. No. 5,749,339 discloses an electronically controlled continuous lubricating oil replacement system which injects the used engine lubricating oil into the engine fuel system during operation based on engine operating conditions. An electronic controller is provided to vary the amount of used lube oil injected into the fuel system based on the severity of engine operation. The system maintains the quality of the engine lube oil at a level necessary to provide optimal engine protection at all engine operating conditions. However, the "worst case" concentration may also be several times higher than the mean concentration possibly making the engine difficult to certify under strict "worst case" standards.

Japanese Patent No. 61-160509 discloses a device for mixing lube oil in a fuel tank which delivers an amount of lube oil set at a predetermined ratio relative to the incremental weight of fuel added. The oil is delivered into the fuel filling section of the fuel tank. U.S. Pat. No. 4,617,879 to Mori discloses a level sensing system that provides a signal to control a lubricant pump so as to inject an amount of oil proportional to the fuel added. However, these systems relate to two-cycle engines and therefore do not suggest removing used oil from the engine's crankcase or lubricating oil system for injection into the fuel system. Also, these systems require the oil reservoir to be replenished manually. These references also rely only on the weight and level of the fuel added.

U.K. Patent Specification No. 867,711 discloses a system for creating a controlled injection of engine lubricating oil into the engine's fuel system. The amount of oil added to the fuel system may be controlled in dependence on engine load in a first embodiment or engine speed in a second embodiment. In both embodiments, oil is injected into the fuel system via a groove formed in a fuel injection pump plunger. In the first embodiment, the annular groove is shaped with a varying cross-section. The plunger is rotated based on engine load to vary the flow area of the groove thereby varying the amount of injected oil. In the second embodiment, oil injection is controlled based on engine speed by varying the oil pressure in the suction chamber. A fuel passage containing a throttle orifice connects the fuel supply pump to the suction chamber. As the volume of fuel injected increases, the pressure in the suction chamber decreases which draws a larger quantity of oil into the chamber. However, this system delivers lubricating oil to the injection pump for injection into the engine. Moreover, this design relies on a distinct groove formed in the pump plunger to create an oil flow path. Also, since this system requires significant modifications to an engine's fuel pump, this system may not be easily retrofit on existing engines.

Therefore, there is a need for an electronically controlled engine lube oil and fuel blending system capable of simply, automatically and effectively delivering used lube oil to an engine fuel system so as to increase the oil change interval while maintaining a lube oil/fuel concentration within acceptable limits.

SUMMARY OF THE INVENTION

It is an object of the present invention, therefore, to overcome the disadvantages of the prior art and to provide a lubricating oil and fuel blending system for an engine capable of reliably, accurately and effectively removing used lube oil from the engine's lube oil system in a controlled manner and delivering the used lube oil into the engine fuel system.

It is another object of the present invention to provide a lubricating oil and fuel blending system capable being easily and inexpensively retrofit on existing engines.

It is yet another object of the present invention to provide a lube oil and fuel blending system which substantially increases the oil change interval, i.e. mileage interval for over-the-road vehicles, to minimize engine down time.

It is a further object of the present invention to provide a lube oil and fuel blending system which accurately and effectively maintains the oil concentration in the engine's fuel system at a level necessary to maintain emissions compliance.

It is a still further object of the present invention to provide an engine lube oil and fuel blending system which is inexpensive and includes a minimum number of additional components to existing engine components.

Still another object of the present invention is to provide a used lube oil and fuel blending system capable of promoting mixing of the lube oil and fuel.

Yet another object of the present invention is to provide a lube oil and fuel blending system which eliminates the need to dispose of used engine oil.

It is a further object of the present invention to provide a lube oil and fuel blending system which maintains the quantity of particulate matter, e.g. soot, in the engine exhaust at an acceptable level.

The above objects are achieved by providing an electronically controlled lube oil and fuel blending system for removing used lube oil from an engine, comprising an engine lube oil supply for supplying lube oil to the engine, a fuel supply for supplying fuel to the engine, a fuel pumping device including a pump body containing a bore and a plunger reciprocally mounted in the bore for movement through a retraction stroke and an advancement stroke. Each of the retraction and advancement strokes have a predetermined stroke length while the bore includes a seal opening communicating with lube oil. Also, the plunger includes an outer portion exposed to lube oil. The lube oil and fuel blending system also includes a fuel drain circuit communicating with the bore at a drain location adjacent the plunger and spaced a predetermined seal length axially along the bore from the seal opening. The predetermined seal length is less than the predetermined stroke length to cause lube oil on the outer portion of the plunger to be delivered by the plunger to the fuel drain circuit at the drain location. The system further includes an annular clearance passage positioned between the plunger and an opposing wall of the pump body forming the bore. The annular clearance passage extends axially from the seal opening to the fuel drain circuit. The plunger preferably includes an outer cylindrical surface free from grooves which extends along the annular clearance passage during both the advancement and retraction strokes. A pressure regulating device may be positioned along the fuel drain circuit to control lube oil drain flow from the annular clearance passage through the fuel drain circuit. The fuel pumping device may be a unit fuel injector including an integrated high pressure chamber containing fuel for pressurization by the plunger and injector orifices for directing high pressure fuel into an engine combustion chamber. Preferably, the predetermined seal length is less than 90% of the predetermined stroke length. In another embodiment, the plunger may include an annular undercut formed in the outer cylindrical surface of the plunger and extending axially along the plunger so as to communicate with the fuel drain circuit throughout a substantial portion of the retraction and advancement strokes.

The present invention is also directed to a fuel and lube oil blending device for removing used lube oil from an engine and delivering the used lube oil to an engine fuel system comprising a fuel pump body including the bore and plunger, and a fuel drain circuit formed in the body wherein the predetermined seal length is less than the predetermined stroke length of the plunger. The present invention is also directed to a method for removing used lube oil from an engine and delivering the used lube oil to an engine fuel system, comprising the steps of supplying lube oil to the engine, supplying fuel to the engine, providing the fuel pumping device including the fuel pump body containing a bore and a plunger, and providing a fuel drain circuit communicating with the bore at a drain location adjacent the plunger and spaced a predetermined seal length axially along the bore from the seal opening wherein the predetermined seal length is less than the predetermined stroke length of the plunger to cause lube oil on the outer portion of the plunger to be delivered by the plunger to the fuel drain circuit at the drain location.

DETAILED DESCRIPTION OF THE INVENTION

Figure 1:
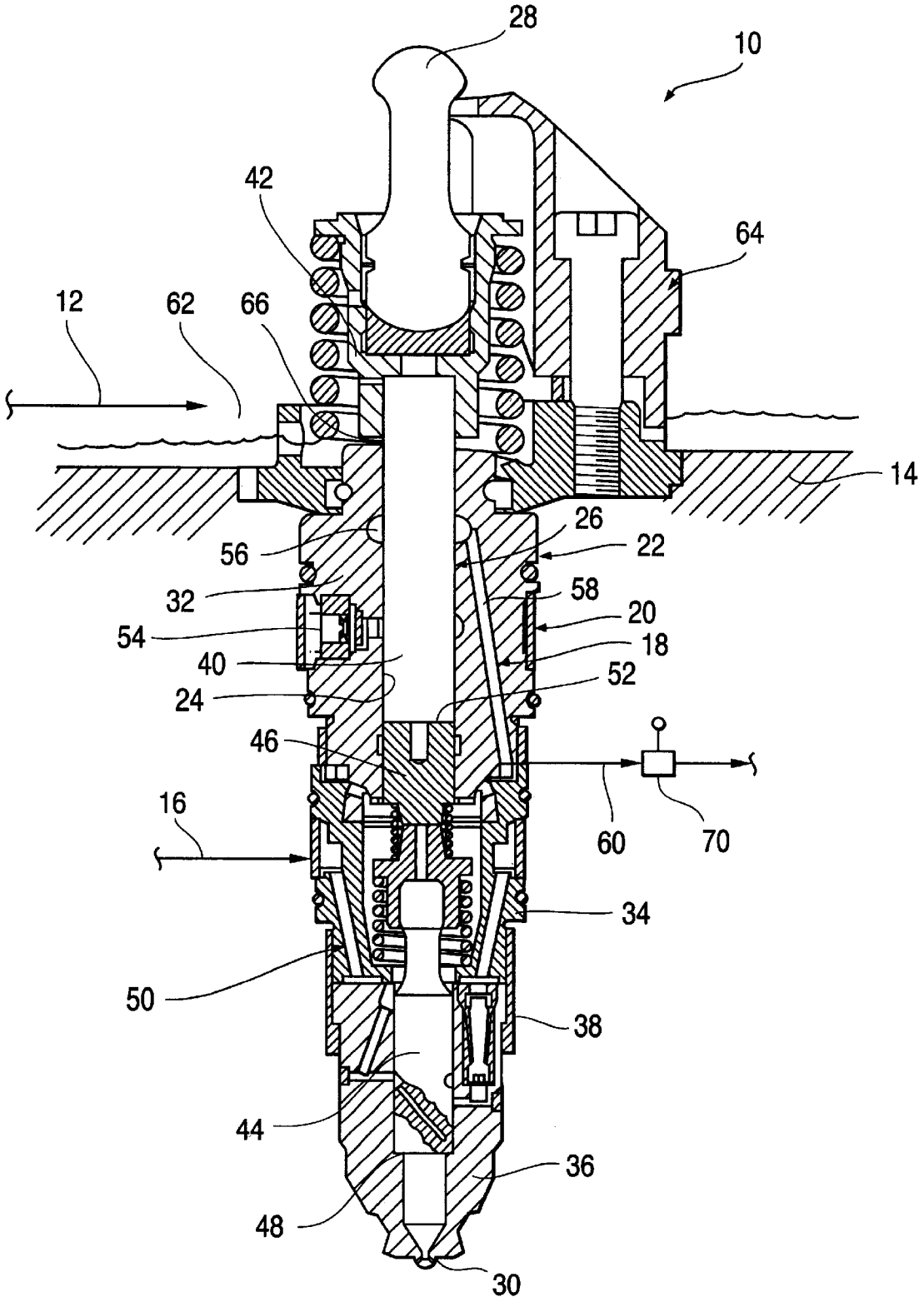
FIG. 1 is a schematic diagram of the lube oil and fuel blending system of the present invention including a cross-sectional view of a fuel pumping device in accordance with the present invention.

Referring to FIG. 1, the lubricating oil and fuel blending system of the present invention, indicated generally at 10, includes an engine lube oil supply 12 for supplying lubricating fluid or oil to an engine 14 for lubricating and cooling engine components, a fuel supply 16 for supplying fuel to the engine, a fuel drain circuit for returning used fuel, e.g. leakage fuel, to the fuel supply system and a fuel pumping device 20 designed to both deliver pressurized fuel to the engine while effectively delivering a controlled amount of used lube oil to fuel drain circuit 18 throughout operation of fuel pumping device 20. Specifically, lube oil and fuel blending system 10 functions to remove small amounts of used lube oil from the engine lube oil system in a controlled manner and deliver the used lube oil to the fuel system of the engine via fuel drain circuit 18 to minimize lube oil waste, minimize the cost of oil change procedures, extend the engine oil change interval and permit the quality of the oil in the engine lube oil supply system to be maintained at a desired level while, importantly, minimizing the installation, new design, retrofit and operation costs of the blending system.

The present lube oil and fuel blending system 10 of the present invention may be used in conjunction with any engine 14 having a lube oil supply system for supplying lubricating oil to the engine for lubricating and cooling the engine. For example, engine 14 may be a reciprocating piston type engine having any number of engine cylinders (not shown). The lube oil and fuel blending system 10 of the present invention is specifically designed to remove used lube oil from an engine having a lube oil supply system so as to assist in maintaining the quality of the lube oil at a predetermined level while extending the oil change interval. Fuel pumping device 20 is preferably in the form of a unit fuel injector including a fuel pump body 22 containing a bore 24 and a plunger assembly 26 mounted for reciprocal movement within bore 24. Plunger assembly 26 is driven by an injector drive train (not shown) via a link 28 to force fuel through injector orifices 30. In the present embodiment, fuel pumping device 20 is in the form of an open nozzle type injector but the present invention may be applied to a closed nozzle injector or any other fuel pump having a plunger positioned in a bore exposed to engine lube oil. Body 22 includes a barrel 32, a spring housing 34 connected to barrel 32, a nozzle housing 36 and a nozzle retainer 38 securing nozzle housing 36 to the lower end of spring housing 34. Spring housing 34 is positioned intermediate outer barrel 32 and nozzle housing 36 while central bore 24 extends through each of the housings. Plunger assembly 26 includes an upper plunger 40 extending outwardly from bore 24 for operative connection with link 28 via a connector 42. Plunger assembly 26 further includes a lower plunger 44 reciprocally mounted in bore 24 of nozzle housing 36 and extending into spring housing 34. Plunger assembly 26 further includes an intermediate or timing plunger 46 reciprocally mounted in bore 24 axially between upper plunger 40 and lower plunger 44. Fuel pumping device 20 also includes a high pressure metering chamber 48 formed near the lower end of central bore 24 for receiving a metered quantity of fuel from fuel supply 16 via fuel transfer passages 50 for injection on a periodic basis.

Figure 2:
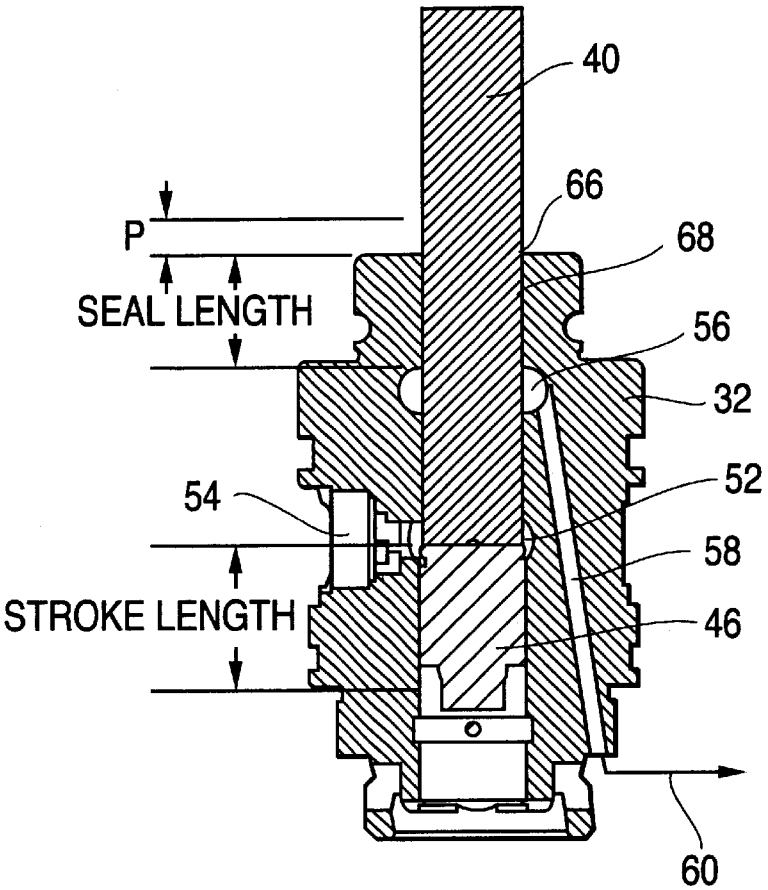
FIG. 2 is an expanded cross-sectional view of a portion of the fuel pumping device of FIG. 1.

A variable volume timing chamber 52 is formed between upper plunger 40 and timing plunger 46 to permit varying the timing of each periodic injection of metered fuel depending upon the pressure of timing fluid supplied to the injector body. A timing fluid inlet 54 is formed in barrel 32 to supply timing fluid to timing chamber 52 during the retraction stroke of plunger assembly 26 (FIG. 2). Fuel drain circuit 18 includes an annular groove 56 formed in barrel 32 and positioned axially along bore 24 between timing fluid inlet 54 and the outer end of bore 24. Fuel drain circuit 18 also includes a drain passage 58 extending from drain groove 56 to communicate with a return line 60 for delivering leakage fuel to the fuel supply system, e.g. fuel supply tank. During operation, plunger assembly 26, and specifically upper plunger 40 moves through an advancement stroke ending in the position shown in FIG. 1 followed by a retraction stroke wherein plunger assembly 26 moves outwardly into the position shown in FIG. 2. At the end of the retraction stroke, timing fluid is delivered into timing chamber 52 via inlet 54 at the beginning of the advancement stroke, the timing fluid and timing chamber 52 is compressed and pressurized until being relieved toward the end of the advancement stroke in a conventional manner. This high pressure timing fluid, i.e. fuel, seeps into the matched clearance between the outer cylindrical surface of upper plunger 40 and the opposing wall of barrel 32 forming bore 24 and flows through drain groove 56 into drain passage 58 for delivery back to the fuel system. This fuel functions in part to lubricate the relative movement between the plunger 40 and bore 24.

Unit injector 20 is typically mounted in a mounting bore formed in engine 14 and extends outwardly into the engine overhead, indicated generally at 62, for operative engagement by the engine drive train (not shown). Fuel injector 20 may secured in the overhead by, for example, a mounting device 64. Engine lube oil supply 12 provides lubricating oil into the engine overhead for lubricating the engine drive train, including the link/drive train interface, the link/connector 42 interface and the connector 42/plunger 40 interface. As a result, the outer end of plunger 40 is necessarily exposed to lube oil and lube oil resides at a seal opening 66 formed at the outer end of bore 24 by the annular clearance between plunger 40 and the opposing wall of barrel 32 forming bore 24.

Lube oil and fuel blending system 10 of the present invention has been designed to effectively remove used lube oil from the engine and deliver the used oil to the fuel return line 60 utilizing existing passages in fuel injector 20 by critical repositioning and/or sizing of the passages. Specifically, as shown in FIG. 2, the features of the present invention enable a predetermined flow of lube oil to be achieved through an annular clearance passage 68 formed between plunger 40 and the opposing surface of barrel 32 forming bore 24. Thus, lube oil is drawn from overhead 62 through seal opening 66 and annular clearance passage 68 into drain groove 56 and through drain passage 58 for delivery to fuel return line 60 for return to the fuel supply system. The present invention achieves the predetermined controlled delivery of lube oil through these passages by positioning drain groove 56 relative to seal openings 66 so that plunger 40 can effectively drag lube oil at seal opening 66 through annular clearance passage 68 to drain groove 56 during the advancement stroke of plunger 40. Lubricating oil and fuel blending system 10 of the present invention effectively creates a leakage or drainage flow of used lube oil from overhead 62 through seal opening 66 and annular clearance passage 68 by specifically positioning drain groove 56 relative to seal opening 66 so that the seal length of annular clearance passage 68 extending between the top edge of drain groove 56 and seal opening 66 is less than the stroke length of plunger 40. Plunger 40 will move from its outermost position (FIG. 2) to an innermost position (FIG. 1) to define a stroke length indicated in FIG. 2. This stroke length is larger than the seal length formed by the matched clearance fit between the outer cylindrical surface of plunger 40 and the inner surface of barrel 32 extending between the upper edge of drain groove 56 and seal opening 66. The difference between the stroke length and the seal length results in a portion P of plunger 40 which not only exits the outer end of bore 24 so that the outer cylindrical surface of plunger 40 corresponding to portion P is not only exposed to used lube oil when in the retracted position but also moves through bore 24 and registers with drain groove 56 so as to drag lube oil through annular clearance passage 68 and into drain groove 56. The lube oil adhering to the outer cylindrical surface of plunger 40 as it moves through drain groove 56 is washed off the outer surface by leakage fuel, i.e. timing fluid, draining into drain groove 56 and carried away to fuel return line 60 via drain passage 58. Therefore, the oil adhering to the outer cylindrical surface of portion P is pulled into annular clearance passage 68 and further dragged into drain groove 56 either on the same stroke or on a subsequent stroke since some used lube oil will naturally adhere to the surfaces defining annular clearance passage 68 and be subsequently dragged into drain groove 56. In this manner, during each cycle of retraction and advancement strokes of plunger 40, used lube oil is extracted from the engine lube oil system and delivered to the fuel return line 60 thereby blending the used lube oil with the fuel for delivery to the fuel supply system and eventual consumption by the engine.

Figure 3:
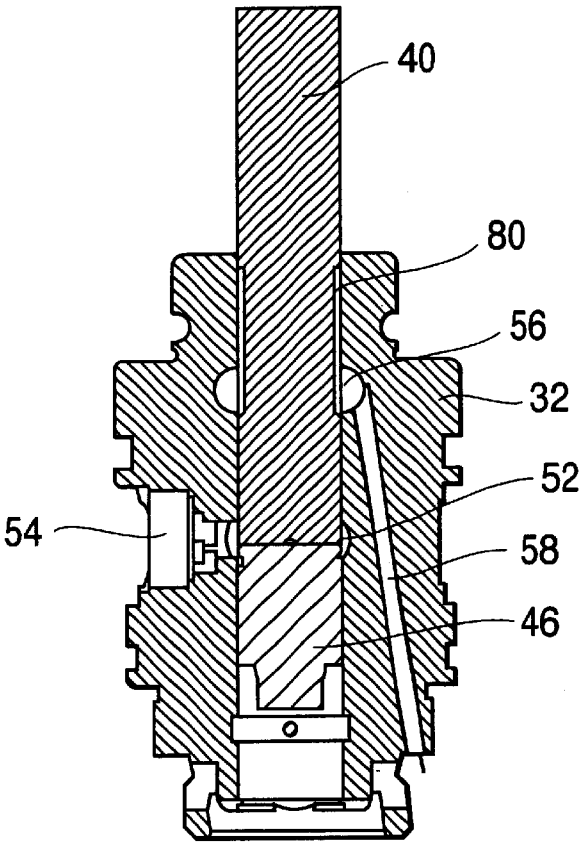
FIG. 3 is an expanded cross-sectional view of a portion of a second embodiment of the fuel pumping device of present invention.
Figure 4:
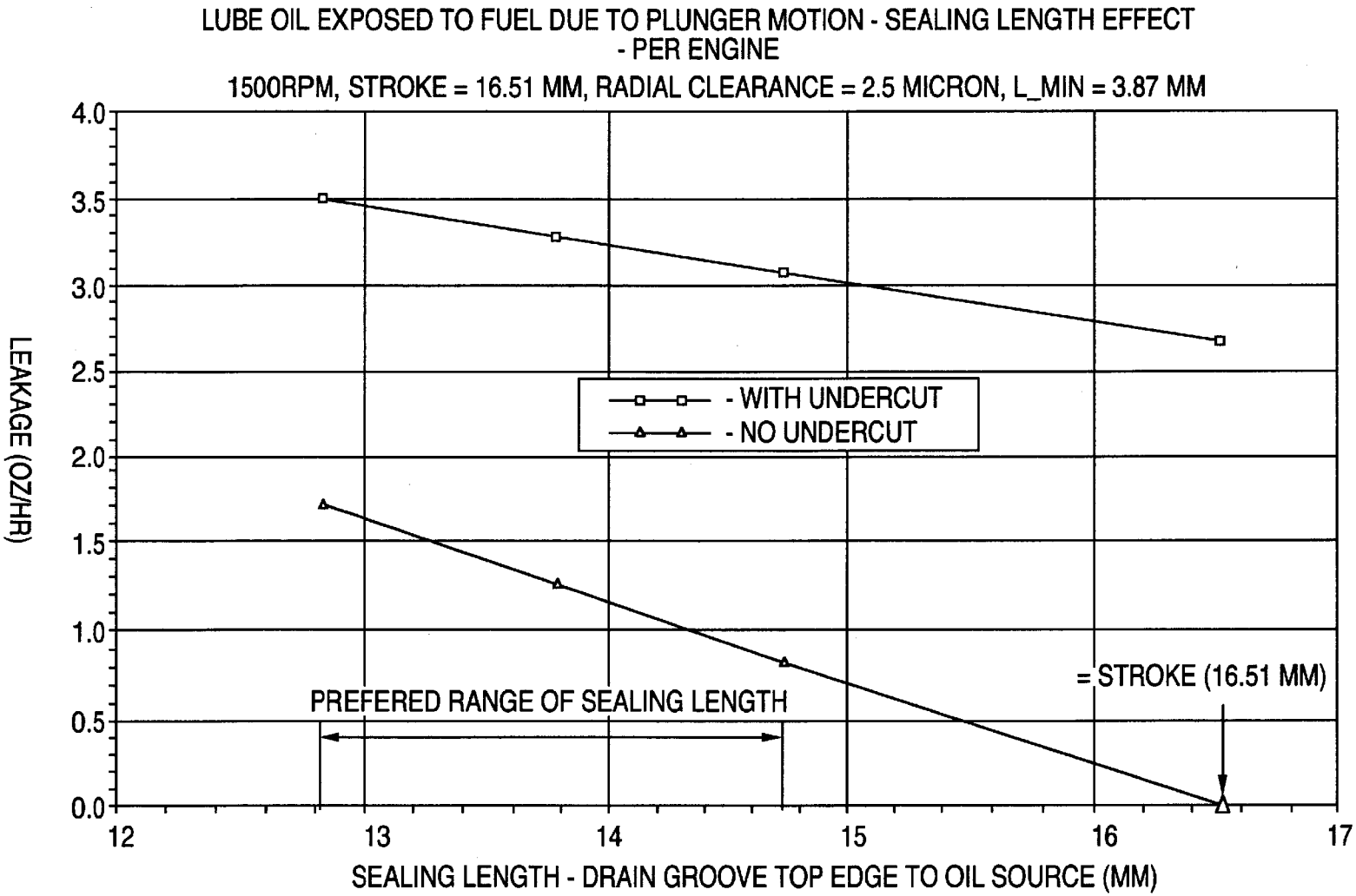
FIG. 4 is a graph illustrating the amount of lube oil delivered in the fuel drain circuit versus sealing length in the system of the present invention.

There are several levers that may also be used to control the amount of used lube oil consumed by the injector during operation. First, lube oil and fuel blending system 10 may also include a variable pressure regulating valve or variable restriction 70 (FIG. 2) positioned along fuel drain circuit 18 for restricting the drain flow to control the back pressure thereby controlling the amount of used oil extracted from the engine. For example, valve 70 may be a proportionally controlled, variable area valve electrically operated and electronically controlled based on, for example, engine duty cycle. This controllable fuel drain line pressure could allow a reduction in circulation if the engine duty cycle is such that soot loading in the used lube oil is not as severe thereby reducing oil consumption as required. The pressure regulating valve 70 may be arranged in a multi-injector engine so as to control the flow from one or any combination of injectors designed with system 10. Second, referring to FIG. 3, an undercut 80 formed in the outer cylindrical surface of plunger 40 so as to form an elongated groove extending longitudinally along plunger 40, may be used to effectively achieve a higher lube oil leakage or consumption rate than without an undercut. Specifically, as shown in FIG. 4, a dramatic increase in the leakage rate can be achieved across a wide range of sealing lengths less than a predetermined stroke length. For example, in the preferred sealing length range shown in FIG. 4, a 100%–300% increase in leakage is achieved with a plunger having an undercut 80 relative to a plunger without an undercut and with a radial clearance of 2.5 microns. Undercut 80, as shown in FIG. 3, minimizes the effective sealing length between drain groove 56 and seal opening 66 and creates a larger leakage clearance chamber for permitting a more effective accumulation and flow of leakage lube oil from the overhead to drain groove 56. Third, referring to FIG. 4, the amount of lube oil leakage/consumption can be set by designing or selecting an injector having a sealing length of a specific size relative to the stroke. The smaller the sealing length relative to a given stroke, the greater the leakage of lube oil through annular clearance passage 68. For example, as shown in FIG. 4, for an injector having a plunger with a stroke of approximately 16.5 mm, a sealing length of approximately 14.8 mm will result in approximately 0.8 ounces per hour of used lube oil leakage/consumption through the injector. On the other hand, at the other end of the preferred range indicated in FIG. 4, a sealing length of 12.8 mm will result in approximately 1.75 ounces per hour of used lube oil leakage. Therefore, for a particular engine, the used oil leakage rate can be selected by selecting the one or more injectors having a sealing length relative to the stroke which corresponds to the desired leakage rate. The lube oil blending/consumption/leakage rate for a particular engine can be modified by selecting or changing the number of injectors on the engine which are designed to cause lube oil consumption by the injector. Therefore, the present invention does not require major engine modifications during manufacture, retrofit or as engine applications are changed. It should also be noted that, except for barrel 32, the remaining components of fuel injector 20 are conventional and therefore only the barrel 32 need be selected for designing injectors having different leakage rates and, consequently, providing a broad range of engine leakage rates depending on the number of injectors used in a particular engine. Lastly, it may also be possible to vary the radial clearance of annular clearance passage 68 to affect the set leakage rate for a given injector having a given sealing length. For example, the diameter of the portion of bore 24 along the sealing length could be slightly larger than a typical diameter required to achieve a matched clearance fit, thereby increasing used lube oil leakage flow.

The lube oil and fuel blending system of the present invention achieves many advantages as set forth hereinabove in the summary of the invention. Specifically, the system, injector and method of the present invention effectively removes used lube oil from an engine in a simple, inexpensive, controlled and reliable manner. In essence, the present invention creates a lube oil consuming injector capable of extracting or consuming used lube oil during normal operation. The present system may be used to increase the oil change interval from, for example, 5,000 miles to 22,000 miles when used in engines of over-the-road vehicles. The present system is particularly advantageous since future emissions legislation is requiring continuous engine operation at retarded injection timings which results in high soot loading of the lube oil due to fuel being injected late and onto the cylinder liner walls and the top of the piston. Excessive soot buildup causes inappropriate cooling and lubrication of engine components thereby increasing wear and engine costs. Moreover, soot buildup in the engine crankcase and oil pan is very difficult to remove. The present system, injector and method provides an effective manner of assisting in meeting future emissions requirements in an inexpensive manner with a minor change to existing fuel injectors and other fuel pumping devices.

Industrial Applicability

The present electronically controlled lube oil and fuel blending system may be used in any internal combustion engine having a replaceable supply of lubricating oil which is cycled through the engine for lubricating the engine's components. However, the present system is particularly useful in a compression ignition engine of any vehicle or industrial equipment.

We claim:

1. A lube oil and fuel blending system for removing used lube oil from an engine, comprising:

an engine lube oil supply for supplying lube oil to the engine;

a fuel supply for supplying fuel to the engine;

a fuel pumping device including a pump body containing a bore and a plunger reciprocally mounted in said bore for movement through a retraction stroke and an advancement stroke, each of said retraction and said advancement strokes having a predetermined stroke length, said bore including a seal opening communicating with lube oil, said plunger including an outer portion exposed to lube oil;

a fuel drain circuit communicating with said bore at a drain location adjacent said plunger and spaced a predetermined seal length axially along said bore from said seal opening, said predetermined seal length being less than said predetermined stroke length to cause lube oil on said outer portion of said plunger to be delivered by said plunger to said fuel drain circuit at said drain location; and an annular clearance passage positioned between said plunger and an opposing wall of said pump body forming said bore, said annular clearance passage extending axially from said seal opening to said fuel drain circuit.

2. The system of claim 1, wherein said plunger includes an outer cylindrical surface free from grooves, said outer cylindrical surface extending along said annular clearance passage during both said advancement and said retraction strokes.

3. The system of claim 1, wherein said fuel pumping device is a unit fuel injector including an integrated high pressure chamber containing fuel for pressurization by said plunger and injector orifices for directing high pressure fuel into an engine combustion chamber.

4. The system of claim 1, wherein said predetermined seal length is less than 90% of said predetermined stroke length.

5. A lube oil and fuel blending system for removing used lube oil from an engine, comprising:

an engine lube oil supply for supplying lube oil to the engine;

a fuel supply for supplying fuel to the engine;

a fuel pumping device including a pump body containing a bore and a plunger reciprocally mounted in said bore for movement through a retraction stroke and an advancement stroke, each of said retraction and said advancement strokes having a predetermined stroke length, said bore including a seal opening communicating with lube oil, said plunger including an outer portion exposed to lube oil;

a fuel drain circuit communicating with said bore at a drain location adjacent said plunger and spaced a predetermined seal length axially along said bore from said seal opening, said predetermined seal length being less than said predetermined stroke length to cause lube oil on said outer portion of said plunger to be delivered by said plunger to said fuel drain circuit at said drain location; and a pressure regulating device positioned along said fuel drain circuit to control lube oil drain flow from said annular clearance passage through said fuel drain circuit.

6. A lube oil and fuel blending system for removing used lube oil from an engine, comprising:

an engine lube oil supply for supplying lube oil to the engine;

a fuel supply for supplying fuel to the engine;

a fuel pumping device including a pump body containing a bore and a plunger reciprocally mounted in said bore for movement through a retraction stroke and an advancement stroke, each of said retraction and said advancement strokes having a predetermined stroke length, said bore including a seal opening communicating with lube oil, said plunger including an outer portion exposed to lube oil; and a fuel drain circuit communicating with said bore at a drain location adjacent said plunger and spaced a predetermined seal length axially along said bore from said seal opening, said predetermined seal length being less than said predetermined stroke length to cause lube oil on said outer portion of said plunger to be delivered by said plunger to said fuel drain circuit at said drain location;

wherein said plunger includes an annular undercut formed in an outer cylindrical surface of said plunger and extending axially along said plunger so as to communicate with said fuel drain circuit throughout a substantial portion of said retraction and said advancement strokes.

7. A fuel and lube oil blending device for removing used lube oil from an engine and delivering the used lube oil to an engine fuel system, comprising:

a fuel pump body containing a bore and a plunger reciprocally mounted in said bore for movement through a retraction stroke and an advancement stroke to pressurize fuel for injection in the engine, each of said retraction and said advancement strokes having a predetermined stroke length, said bore including a seal opening communicating with lube oil, said plunger including an outer portion exposed to lube oil;

a fuel drain circuit formed in said fuel pump body to communicate with said bore at a drain location adjacent said plunger and spaced a predetermined seal length axially along said bore from said seal opening, said predetermined seal length being less than said predetermined stroke length to cause lube oil on said outer portion of said plunger to be delivered by said plunger to said fuel drain circuit at said drain location; and a pressure regulating device positioned along said fuel drain circuit to control lube oil drain flow from said annular clearance passage through said fuel drain circuit.

8. A fuel and lube oil blending device for removing used lube oil from an engine and delivering the used lube oil to an engine fuel system, comprising:

a fuel pump body containing a bore and a plunger reciprocally mounted in said bore for movement through a retraction stroke and an advancement stroke to pressurize fuel for injection in the engine, each of said retraction and said advancement strokes having a predetermined stroke length, said bore including a seal opening communicating with lube oil, said plunger including an outer portion exposed to lube oil;

a fuel drain circuit formed in said fuel pump body to communicate with said bore at a drain location adjacent said plunger and spaced a predetermined seal length axially along said bore from said seal opening, said predetermined seal length being less than said predetermined stroke length to cause lube oil on said outer portion of said plunger to be delivered by said plunger to said fuel drain circuit at said drain location; and an annular clearance passage positioned between said plunger and an opposing wall of said fuel pump body forming said bore, said annular clearance passage extending axially from said seal opening to said fuel drain circuit.

9. The system of claim 8, wherein said plunger includes an outer cylindrical surface free from grooves, said outer cylindrical surface extending along said annular clearance passage during both said advancement and said retraction strokes.

10. The system of claim 8, wherein said fuel and lube oil blending device is a unit fuel injector including an integrated high pressure chamber containing fuel for pressurization by said plunger and injector orifices for directing high pressure fuel into an engine combustion chamber.

11. The system of claim 8, wherein said predetermined seal length is less than 90% of said predetermined stroke length.

12. A method for removing used lube oil from an engine and delivering the used lube oil to an engine fuel system, comprising the steps of:

supplying lube oil to the engine;

supplying fuel to the engine;

providing a fuel pumping device including a fuel pump body containing a bore and a plunger reciprocally mounted in said bore for movement through a retraction stroke and an advancement stroke, each of said retraction and said advancement strokes having a predetermined stroke length, said bore including a seal opening communicating with lube oil, said plunger including an outer portion exposed to lube oil;

providing a fuel drain circuit communicating with said bore at a drain location adjacent said plunger and spaced a predetermined seal length axially along said bore from said seal opening, said predetermined seal length being less than said predetermined stroke length to cause lube oil on said outer portion of said plunger to be delivered by said plunger to said fuel drain circuit at said drain location, further including an annular clearance passage positioned between said plunger and an opposing wall of said fuel pump body forming said bore, said annular clearance passage extending axially from said seal opening to said fuel drain circuit.

13. The method of claim 12, wherein said plunger includes an outer cylindrical surface free from grooves, said outer cylindrical surface extending along said annular clearance passage during both said advancement and said retraction strokes.

14. The method of claim 12, wherein said fuel pumping device is a unit fuel injector including an integrated high pressure chamber containing fuel for pressurization by said plunger and injector orifices for directing high pressure fuel into an engine combustion chamber.

15. The method of claim 12, wherein said predetermined seal length is less than 90% of said predetermined stroke length.

16. A method for removing used lube oil from an engine and delivering the used lube oil to an engine fuel system, comprising the steps of:

supplying lube oil to the engine;

supplying fuel to the engine;

providing a fuel pumping device including a fuel pump body containing a bore and a plunger reciprocally mounted in said bore for movement through a retraction stroke and an advancement stroke, each of said retraction and said advancement strokes having a predetermined stroke length, said bore including a seal opening communicating with lube oil, said plunger including an outer portion exposed to lube oil;

providing a fuel drain circuit communicating with said bore at a drain location adjacent said plunger and spaced a predetermined seal length axially along said bore from said seal opening, said predetermined seal length being less than said predetermined stroke length to cause lube oil on said outer portion of said plunger to be delivered by said plunger to said fuel drain circuit at said drain location, further including a pressure regulating device positioned along said fuel drain circuit to control lube oil drain flow from said annular clearance passage through said fuel drain circuit.

* * * * *